US005529184A

United States Patent [19]

Sadow

[11] Patent Number: 5,529,184

[45] Date of Patent: Jun. 25, 1996

[54] PROTECTIVE DEVICE FOR A PERSONAL COMUPUTER

[75] Inventor: Bernard D. Sadow, Chappaqua, N.Y.

[73] Assignee: Outrigger, Inc., Chappaqua, N.Y.

[21] Appl. No.: 396,672

[22] Filed: Mar. 1, 1995

[51] Int. Cl.[6] ..... B65D 81/02; B65D 85/30

[52] U.S. Cl. ..... 206/320; 206/472; 206/478; 206/521; 206/583

[58] Field of Search ..... 206/576, 320, 206/305, 477, 478, 479, 472, 495, 521, 583

[56] References Cited

U.S. PATENT DOCUMENTS 1,201,979 10/1916 Noyes ..... 206/478

3,521,743 7/1970 Sposito Jr. ..... 206/583

4,865,200 9/1989 Sullivan et al. ..... 206/521 X 5,217,119 6/1993 Hollingsworth ..... 206/320 X 5,285,902 2/1994 Garcia ..... 206/583

*Primary Examiner*—Jacob K. Ackun

*Attorney, Agent, or Firm*—Abelman, Frayne & Schwab

[57] ABSTRACT

A protective device for a electronic instrument such as a personal computer includes a springy frame that supports a diaphragm in the manner of a drum skin, the electronic instrument or personal computer being attached directly to the diaphragm and being supported thereby.

9 Claims, 3 Drawing Sheets

PROTECTIVE DEVICE FOR A PERSONAL COMUPUTER

FIELD OF THE INVENTION

This invention relates to a protective device for a personal computer, commonly called a lap-top computer, that can provide protection against edge-wise impacts on the computer while it is being transported in a briefcase, a suitcase, or other article of luggage.

BACKGROUND OF THE INVENTION

Protective cases for personal computers are well known in the art, such protective cases more usually being in the form of a wallet, the interior of which has been suitably padded.

Those cases for personal computers have found consumer acceptance, in that they are light in weight, usually flexible, and are easily stored within a briefcase or suitcase, and, in the main, perform admirably in providing protection for a personal computer, the usual weight of which is in the order of 10 pounds.

A weight of 10 pounds, when dropped onto a hard surface from a height of 30 inches, can, however, produce a force of 1100 G or more, a large proportion of that G force being transmitted directly through the side walls of the protective case, this resulting in damage to the personal computer itself, even though the personal computer does not impact directly on the hard surface. Further, the protective case offers relatively little protection to the personal computer in the event that the briefcase or suitcase is dropped down a flight of stairs.

Attempts to increase the extent of protection afforded by the protective case have resulted in either making the protective case itself more impact resistant, or, by increasing the extent of padding provided by the protective case. In those instances, either a weight or a volume penalty is imposed by the reinforcement of the protective case.

The problem of possible damage to the personal computer upon dropping of either the protective case or the briefcase or suitcase within which the protective case is confined becomes further exaggerated in the event that the impact is on a corner of the personal computer, instead of being evenly distributed along one of the lateral edge faces thereof.

OBJECT OF THE INVENTION

It is an object of this invention to provide a protective device for a personal computer that will to a major extent eliminate the possibility of impacts on corners of the personal computer or on the longitudinally extending side faces thereof.

It is a further object of this invention to provide a device for the purpose stated that is extremely light in weight, is of minimal volume, and one which is not prone to contamination by dirt, lint or grit, such as can occur in the known wallet-type carrying cases.

SUMMARY OF THE INVENTION

According to the present invention, the protective device for a personal computer includes a substantially rectangular frame made of a light weight material that is springy and resilient, while at the same time being of light weight.

Convenient materials from which the frame can be formed include spring steel, fiber glass, reinforced plastics materials, and, laminated wood in strip form.

The substantially rectangular frame surrounds a diaphragm preferably made of a fabric material that is resistant to stretching, such as a woven fabric comprised of monofilamentary yarns, or a scrim formed of random fibers that have been bonded to each other in order to provide a sheet having minimum stretch characteristics in all directions.

The fabric, when properly secured to the peripheral frame, resists flexure of the frame in the plane of the frame, in the manner of a drum skin.

Alternatively, the frame and diaphragm can be molded as a single unit.

The personal computer is secured directly to the fabric diaphragm by means of straps, and is thus suspended spaced within the perimeter of the substantially rectangular frame, and thus is protected by the substantially rectangular frame against any impacts on the longitudinal side edges or corners of the personal computer.

Preferably, the substantially rectangular frame has rounded corners, and also, preferably, the longitudinal sides of the frame are bowed outwardly instead of being axially straight.

By so forming the frame, any impacts received on the rounded corners are translated into stretching forces in the substantially unstretchable diaphragm. Similarly, impact forces on the outwardly bowed longitudinal edges of the frame are translated into lateral stretching forces in the diaphragm, which is specifically constructed to withstand such lateral stretching.

In this manner a protective device is provided for a personal computer, the protective device being of minimal weight and volume, and of a configuration that readily can be stored within an existing article of luggage such as a briefcase, portfolio or a suitcase.

DESCRIPTION OF THE DRAWINGS

The invention will now be described with reference to the accompanying drawings which illustrate preferred embodiments of the invention, and, in which.

DESCRIPTION OF THE PREFERRED EMBODIMENTS

Figure 1:
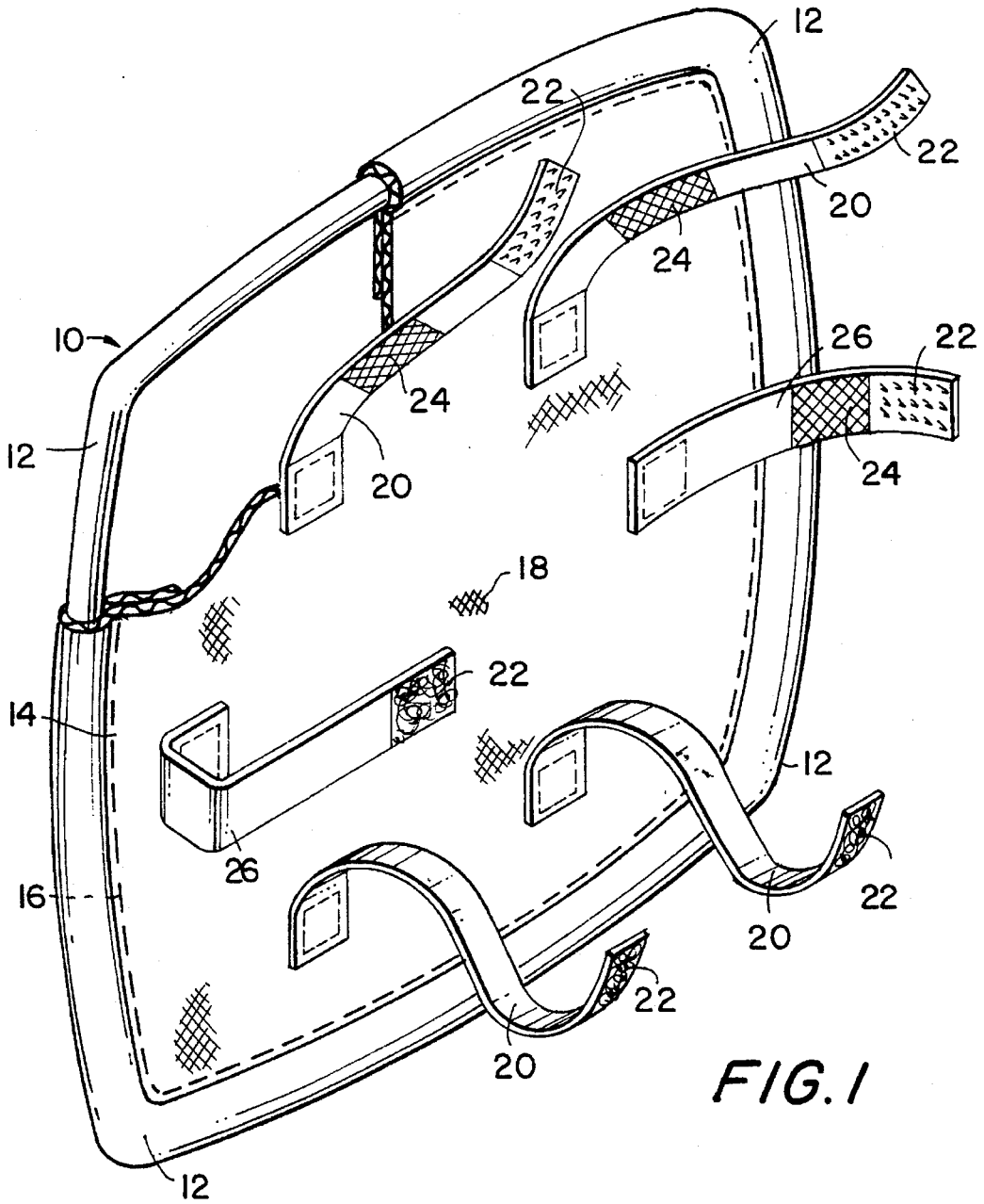
FIG. 1 is a perspective view of the device of the present invention.

Referring to FIG. 1, the device of the present invention includes a frame 10 of substantially rectangular configuration, and which preferably has rounded corners 12.

The frame itself is formed of any suitable material that is springy and resilient. Suitable materials are spring steel rod, fiber glass rod, reinforced plastics materials in rod form, suitable unreinforced plastics materials in rod form, laminated spring metal or laminated wood in strip form, and composites of such materials, such as plastic coated spring steel rod.

The frame 10 is peripherally continuous, such as easily can be provided by butt end welding or cementing of spring metal rod or plastics rod by processes that are commonly known in the art, or by molding the frame.

Figure 5:
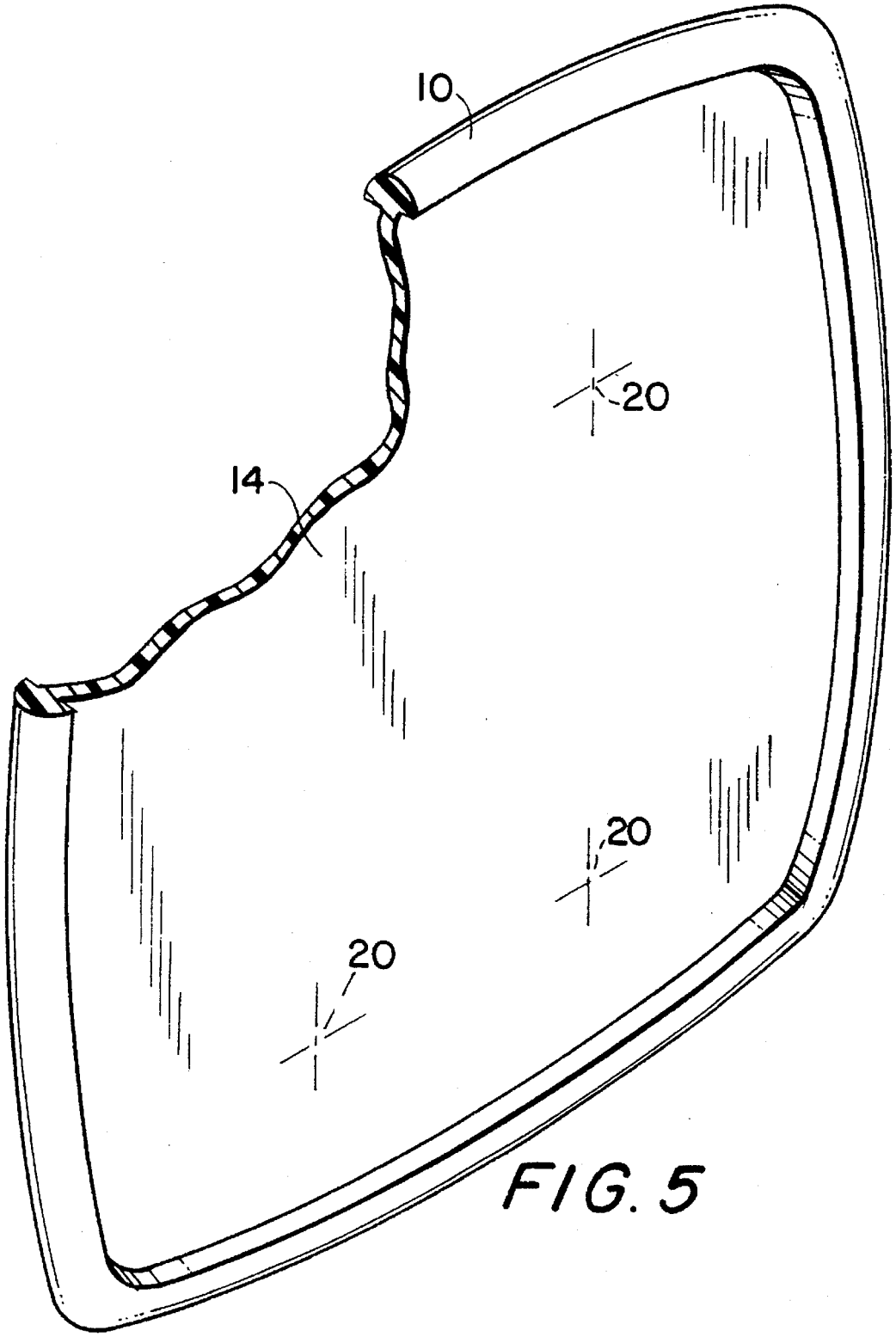

Secured to the frame 10 is a diaphragm 14 formed of a substantially non-stretchable fabric material, which as indicated at 16 can be stitched around the frame 10, and which, as indicated at 18 conveniently can be a woven fabric formed of warp and weft strands of monofilamentary yarn, thus to provide minimum stretch in the vertical and horizontal directions as illustrated in FIG. 1. Alternatively, the diaphragm 14 can be formed from a non-woven scrim comprised of random fibers that have been bonded to each other, again as well known in the art, thus to provide a diaphragm having minimal stretch in any directions in the plane of the fabric. Alternatively, the diaphragm 14 can be provided by a molding of plastics material that has been molded over the frame 10 in the form of the diaphragm 14, or which has been molded integrally with the frame as shown in FIG. 5.

Straps 20 are secured at one end to the diaphragm 14 by any convenient means, such as by stitching or adhesives, the straps including Velcro [RTM] fasteners 22 permitting the straps to be secured around a personal computer [not shown], which is then firmly held on the diaphragm by the straps and protected at each of its longitudinal side edges by the frame 10.

Preferably, at least one pair of the straps 20 include an insert of an elastic material facilitating compressive stretching of the straps around the personal computer.

Optionally, a laterally extending pair of straps 26 can be provided, similarly including fastener elements and an elastic insert.

When secured to the device of the invention by the straps, the personal computer becomes suspended on the diaphragm itself, which acts somewhat in the manner of a drum skin surrounded by a protective rim constituted by the frame 10.

It has been found in tests, that whereas an unprotected computer dropped by 30 inches onto a hard surface can result in G forces of 1,100 G or more, the same computer when dropped edge-wise onto the same surface by the same distance only produces a G force of 70 G or less when protected by the device of this invention, i.e., the personal computer is only subjected to forces that are expected to be encountered in the normal handling of the personal computer.

Figure 2:
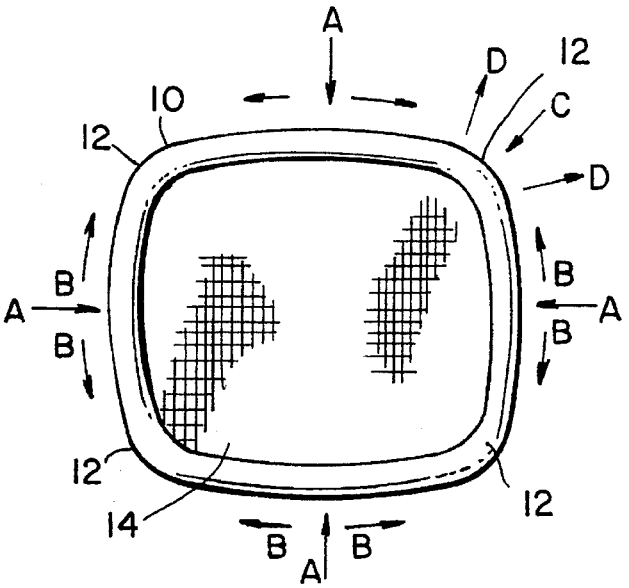
FIG. 2 illustrates a modification thereof.

FIG. 2 illustrates a modification of the device of FIG. 1, in which the frame 10, while retaining its rounded corners 12 is formed outwardly bowed between the corners, the frame 10 being secured to the perimeter of the non-stretchable diaphragm 14.

If now an impact should occur in the direction of the arrows A on the sides of the frame 10, that force is translated into a force indicated by the arrows B, forces in the directions of the arrows B acting to expand the frame 10. Such expansion of the frame 10 is, however, inhibited by its confinement by the non-stretchable diaphragm 14.

Similarly, impacts on the corners 12 in the direction of the arrows C will produce reaction forces in the directions of the arrows D attempting to expand the frame 10, expansion of the frame 10 for the same reasons being inhibited by the substantially non-stretchable diaphragm 14.

Figure 3:
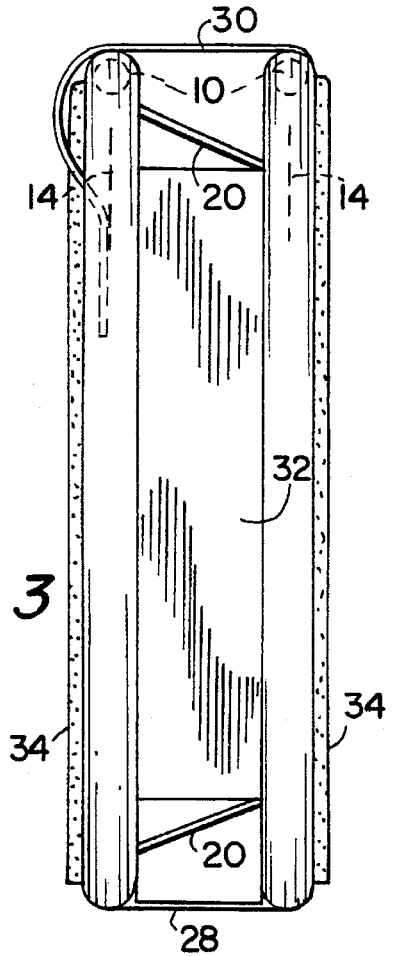
FIG. 3 illustrates a further alternative.

Conveniently, and more particularly in regard to consumer acceptance, the device of the present invention can be formed somewhat in the manner of a book cover as illustrated in FIG. 3. Dual frames 10 and diaphragms 14 are interconnected at one side edge by a strap 28, and are connected to each other at the opposite edge by a strap 30 provided with an appropriate connector.

FIG. 3 illustrates a personal computer 32 when supported on one of the diaphragms 14 by straps 20, and which is then overlaid by the other diaphragm 14. Conveniently, the diaphragms 14 can be coated on their surface remote from the personal computer 32 with a shock absorbent material, such as a foamed plastics material sponge, as indicated at 34.

Figure 4:
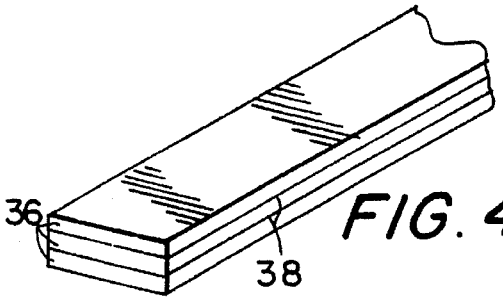
FIG. 4 illustrates a laminate suitable for use in the manufacture of the peripheral frame of the device; and, FIG. 5 illustrates a molded embodiment of the device.

As an alternative to employing spring metal rod, plastics rod and combinations of those materials, the frame 10 can be formed from a laminate of strip material as indicated in FIG. 4, the laminate conveniently consisting of strip spring metal or wooden strips form 36, that have been face bonded to each other by suitable adhesive 38.

An alternative manner of forming the device is illustrated in FIG. 5, in which the frame 10 and diaphragm 14 are molded as a unitary molding of an appropriate plastics material.

Other manners of construction will be apparent to persons skilled in the art for accomplishing the same objectives as have been described above, in order to provide the resilient frame which encircles and holds extended the essentially non-stretchable diaphragm, the personal computer being attached to the diaphragm at a position spaced inwardly of the frame in any convenient manner, including that of attaching a conventional carrying case for a personal computer to the diaphragm.

I claim:

1. A protective device for an electronic instrument, such as a personal computer including:

a diaphragm formed from a material having high resistance to stretching;

a frame of a springy resilient material providing a peripheral perimeter of said diaphragm, whereby said diaphragm is supported in the manner of a drum skin, and, means for attaching said electronic instrument to said diaphragm at a position spaced inwardly of said peripheral frame.

2. The device of claim 1, in which said frame is substantially rectangular and has rounded corners.

3. The device of claim 1, in which said frame is substantially rectangular, has rounded corners, and is outwardly bowed between said corners.

4. The device of claim 1, in which said frame is formed from a material selected from the group of spring metal, fiber glass, reinforced plastics material, unreinforced plastics material, and wood strip.

5. The device of claim 4, in which said frame is formed of composites of said materials.

6. The device of claim 5, in which said frame is formed of laminates of said materials.

7. The device of claim 1, in which said diaphragm is comprised by fabric woven from yarns of monofilaments.

8. The device of claim 1, in which said diaphragm is formed from a scrim of bonded monofilaments.

9. The device of claim 1, in which said frame and diaphragm are formed integrally as a molding of plastics material.

* * * * *